United States Patent [19]

Graybeal et al.

[11] 4,293,243

[45] Oct. 6, 1981

[54] MINE ROOF BOLT ASSEMBLY GUARD

[75] Inventors: Carl N. Graybeal, General Delivery, Wolf Pen, W. Va. 24896; Basil E. Rogers, Beckley, W. Va.; Joseph V. Cox, Stanaford, W. Va.; Roy R. Rogers, Beckley, W. Va.

[73] Assignee: Carl N. Graybeal, Wolf Pen, W. Va.

[21] Appl. No.: 12,145

[22] Filed: Feb. 14, 1979

[51] Int. Cl.[3] ..... A47G 3/00; E21D 21/00

[52] U.S. Cl. ..... 405/259; 405/303; 411/373; 411/548

[58] Field of Search ..... 85/53, 54, 55, 56; 405/259, 260, 261, 303

[56] References Cited

U.S. PATENT DOCUMENTS

| | | | |
|---|---|---|---|
| 1,594,943 | 8/1926 | Haggard | 85/56 |
| 1,886,721 | 11/1932 | O'Brien . | |
| 1,931,899 | 10/1933 | McLeod | 85/53 |
| 2,003,595 | 6/1935 | Kauffman | 85/9 R |
| 2,383,703 | 8/1945 | Boelter . | |
| 2,538,483 | 1/1951 | Summers | 85/53 |
| 2,690,693 | 10/1954 | Campbell | 405/259 X |
| 2,850,937 | 9/1958 | Ralston | 85/62 |
| 2,857,597 | 10/1958 | Morgan | 2/3 |
| 3,153,973 | 10/1964 | Marietta . | |
| 3,415,064 | 10/1968 | Talobre . | |
| 3,485,134 | 12/1969 | Ott | 85/55 |
| 3,508,650 | 4/1970 | Carr | 209/399 |
| 4,095,430 | 6/1978 | Hannan | 405/259 |
| 4,112,693 | 9/1978 | Collin et al. | 405/259 |

FOREIGN PATENT DOCUMENTS

| | | | |
|---|---|---|---|
| 21145 | 8/1905 | Austria | 85/55 |
| 1495105 | 8/1967 | France | 405/259 |
| 806 | of 1890 | United Kingdom | 85/53 |
| 916161 | 1/1963 | United Kingdom | 85/53 |

OTHER PUBLICATIONS

"Slide Fastener" Brochure from Steck Manufacturing Co. of Dayton Ohio, 1956, 2 pages.

*Primary Examiner*—Thomas J. Holko

*Attorney, Agent, or Firm*—Oblon, Fisher, Spivak, McClelland & Maier

[57] ABSTRACT

A guard for a mine roof bolt assembly is disclosed. The guard consists of a cap having a cavity into which the mine roof bolt head is inserted. The cavity wall includes serrations which grip the bolt head and secure the guard on it. A continuous annular skirt depends from the cap and extends outward to completely cover the bolt plate. The skirt curves in the radial direction towards the plate so that the guard presents a substantially smooth curved surface to a passing miner. The skirt includes cut-outs corresponding to the positions of hanger loops on the bolt plate. The guards may also include luminescent or colored material.

3 Claims, 2 Drawing Figures

MINE ROOF BOLT ASSEMBLY GUARD

BACKGROUND OF THE INVENTION

1. Field of the Invention

The present invention relates to protective devices for bolts and, more particularly, protective guards for mine roof bolt assemblies.

2. Description of the Prior Art

Mine roof bolt assemblies, consisting of a mine roof bolt and a roof bolt plate, are well known. The mine roof bolt assemblies have been utilized for maintaining and reinforcing the structural integrity of mine roofs as well as to act as convenient points of attachment for support cables or other mining paraphernalia. In use, the bolts were implanted up to their heads at distances of up to every four feet in the mine roof; the bolt plates were fit around the bolts, in a manner similar to washers, and caused to snugly rest between the bolt heads and the mine roof to support the mine roof.

The mine roof bolt assemblies of the prior art, however, presented a serious safety defect. Mine tunnels are often only a few feet high and the bolt heads and bolt plates, which extend down from the low mine roofs, presented sharp projections which could easily injure a passing miner by causing a gash in the head, or other body portion contacting the projecting roof bolt assembly.

SUMMARY OF THE INVENTION

It is therefore an object of this invention to provide an apparatus for eliminating the danger of injury to a miner due to the projecting portions of a mine roof bolt assembly.

It is a further object of the present invention to provide an apparatus which may be attached to, and cover, a mine roof bolt assembly and which presents no sharp projections to a miner.

It is a further object of the present invention to provide a mine roof bolt assembly guard having cut outs to permit access to hanger loops on the mine roof bolt assembly.

It is a further object of the present invention to provide a mine roof bolt assembly guard which includes luminescent material to act as a guide in the case of a power failure.

It is yet a further object of the present invention to provide a mine roof bolt assembly guard which is color coded for the tunnel in which it is used.

The above objects are carried out by the provision of a guard which can be removably fixed to the roof bolt head. The guard consists of a cap having a cavity into which the bolt head may be inserted and serrations, or other fixing means, for removably fixing the cap on the bolt. Surrounding each cap is a continuous annular skirt which is unitarily formed with the cap. The skirt extends outward from the cap by at least a sufficient distance to completely cover the bolt plate. Preferrably the outer periphery of the skirt is of the same shape as the outer periphery of the bolt plate. The lower face of the cap is flat and the skirt curves gradually towards the mine roof in the outward raidal direction so that the guard presents a substantially smooth surface to any passing object, such as a miner. In this way, if a miner contacts the guard, there will be no sharp projections present to injure him. Rather, due to the smoothness and curvature of the skirt, he will strike a glancing blow and will easily slide or bounce over the surface of the guard without injury.

An additional feature of the guard of the present invention is the provision of cut-outs in the surface of the skirt. In conventional mine roof bolt assemblies, hanger loops are stamped from the bolt plate for various purposes, such as for hanging support cables. In order to permit access to these hanger loops, the cut-outs are positioned to correspond to the positions of the hanger loops.

Another feature of the guard of the present invention is the provision of luminescent material incorporated into, or on, the guard. The luminescent material will cause the guards to glow in the case of a power failure thereby pointing out the directions of escape routes to miners trapped by the power failure.

Finally, it is contemplated that the guards may be color coded for the tunnels in which they are used. In this way they act as route markers identifying the various tunnels of the mine.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein like reference characters designate like or corresponding parts throughout the several views, and wherein.

DETAILED DESCRIPTION OF THE PREFERRED EMBODIMENTS

Figure 1:
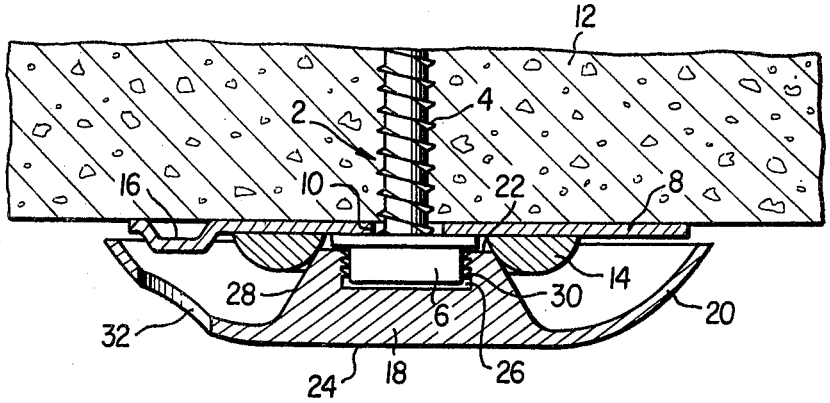
FIG. 1 is a side view, in cross section, of a mine roof bolt assembly and guard.

A conventional mine roof bolt assembly is shown in FIG. 1. It consists of a bolt 2 having a shaft 4 and a head 6. A bolt plate 8, having a central aperture 10 is placed around the shaft 4 and the bolt is implanted in the roof 12 of a mine tunnel until its head supports and securely presses the bolt plate 8 against the surface of the mine roof. In this way, the bolt 2, through the bolt head 6 and bolt plate 8, supports the surface of the mine roof.

The bolt shaft 4 may be of any length sufficient to secure it in the mine roof. The bolt plate 8 may be of any desired shape including round, square, or oblong.

The bolt plate 8 may also include an annular ring 14 surrounding the aperture 10 and intended to protect the bolt head 6.

A number of hanger loops 16 may be stamped from the bolt plate. The hanger loops may be used for hanging support cables or the like. Only one hanger loop is shown in FIG. 1 however the bolt plate 8 may contain several such loops.

The mine roof bolt assembly guard of the present invention consists of a unitary bolt head cap 18 and continuous depending skirt 20. The guard may be composed of any suitable material such as wood, metal or plastic. The cap 18 includes an upper surface 22, a flat lower surface 24 and a cavity 26 in the upper surface. The side walls 28 of the cap 18 preferrably slant outward in the direction towards the lower surface 24.

The cavity 26 is of a size and shape to snugly accommodate the bolt head 6. In the preferred embodiment, it contains serrated edges 30 on its side surfaces which tightly grip the side surfaces of the bolt head 6 to removably secure the guard on the bolt assembly. However, other removable securement means, such as glue or a metal clip, may also be used. It is also possible to glue or secure the guard directly to the bolt plate.

Figure 2:
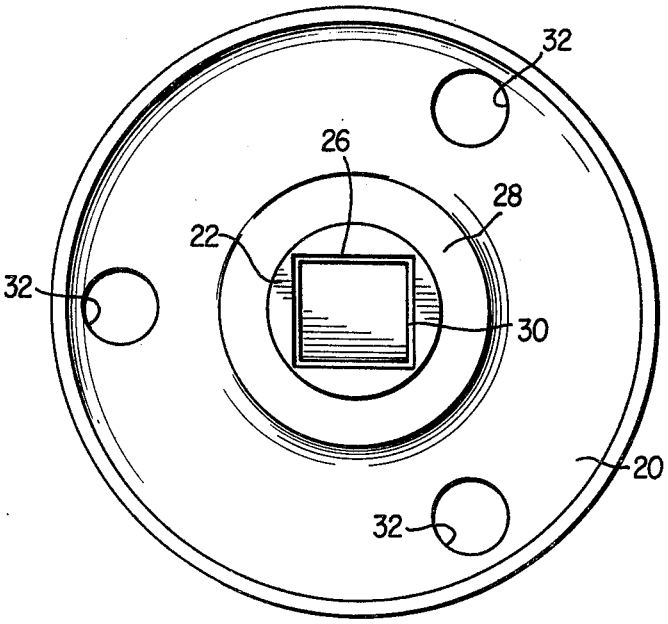
FIG. 2 is a top view of a mine roof bolt assembly guard.

The annular skirt 20 of the guard is unitarily formed with the cap 18 and extends outward from adjacent the lower surface 24. The skirt extends outward by at least a sufficient distance to completely cover the bolt plate 8. The outer periphery of the skirt 20 may be of any shape but is preferrably of the same shape as the outer periphery of the bolt plate. A round shape is shown in FIG. 2.

The annular skirt 20 also gradually curves in the radial direction towards the plane of the upper surface 22 as it extends outward from the cap 18. The guard therefore presents, to a passing miner, a substantially annular, radially curved shape. The center of the lower surface of the guard, however, is flattened at 24 in order to maintain a minimum extension of the guard into the mine tunnel. The border between the flattened surface 24 and the curved skirt is gradual to prevent any sharp corners from being presented.

In this manner, a miner travelling through the mine tunnel in a direction parallel to the mine roof, who strikes the guard, will glance off of the curved furfaces of the guard and slide or bounce past it without injury.

Cut-outs 32 may be formed in the skirt 20. The cut-outs are positioned to correspond to the locations of the hanger loops 16 in the bolt plate 8 and permit access to them when necessary.

The guards may be impregnated or coated with luminescent material, or may be composed of a compound which includes luminescent material. The luminescence is advantageous in the case of a power failure where the guards can indicate the routes of the tunnels to the miners.

The guards may also be color coded for the tunnels in which they are to be used. The color, which may also be the source of the luminescence, is impregnated or coated on the guard, or the guard may be composed of a compound which includes the colored material.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In combination with a mine roof bolt assembly comprising a mine roof bolt having a head and a mine roof bolt plate adapted to fit around said bolt, a guard comprising:

a cap adapted to fit over the head of said bolt, said cap including an upper surface, a lower surface and a cavity in said upper surface into which said mine roof bolt head may be inserted;

fixing means associated with said cavity for removably fixing said cap to said bolt head; and an annular skirt, depending from said cap and extending outward from adjacent said lower surface for a distance at least sufficient to completely cover said bolt plate, said skirt gradually curving towards said bolt plate;

wherein said mine roof bolt assembly includes hanger loops and said skirt includes cut-outs in positions corresponding to said loops;

wherein said guard presents a substantially continuous surface, having a curved periphery, to a passing miner.

2. The apparatus of claim 1 wherein said guard includes luminescent material.

3. The apparatus of claim 1 wherein said guard includes material of a specific color, the color of all said guards in a given mine tunnel being the same.

* * * * *